US006894654B2

(12) United States Patent
Lynch

(10) Patent No.: US 6,894,654 B2
(45) Date of Patent: May 17, 2005

(54) WAVEGUIDE FOR A TRAVELING WAVE ANTENNA

(75) Inventor: Jonathan J. Lynch, Oxnard, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 10/206,741

(22) Filed: Jul. 26, 2002

(65) Prior Publication Data

US 2003/0048232 A1 Mar. 13, 2003

Related U.S. Application Data

(60) Provisional application No. 60/322,125, filed on Sep. 11, 2001.

(51) Int. Cl.[7] ..... H01Q 13/10
(52) U.S. Cl. ..... 343/771; 343/772; 343/785
(58) Field of Search ..... 343/770, 771, 343/772, 767, 785, 909

(56) References Cited

U.S. PATENT DOCUMENTS

| | | | | | |
|---|---|---|---|---|---|
| 3,623,118 | A | * | 11/1971 | Monser et al. | 343/883 |
| 3,977,006 | A | | 8/1976 | Miersch | 343/778 |
| 5,266,961 | A | | 11/1993 | Milroy | 343/772 |
| 5,349,363 | A | | 9/1994 | Milroy | 343/772 |
| 5,352,997 | A | * | 10/1994 | Sarkka | 333/219.1 |
| 6,008,771 | A | | 12/1999 | Tanaka et al. | 343/767 |
| 6,031,433 | A | * | 2/2000 | Tanizaki et al. | 333/26 |
| 6,518,932 | B1 | * | 2/2003 | Matsui et al. | 343/770 |

FOREIGN PATENT DOCUMENTS

| | | |
|---|---|---|
| EP | 0 969 548 | 1/2000 |
| FR | 895783 | 2/1945 |

* cited by examiner

*Primary Examiner*—Shih-Chao Chen
(74) *Attorney, Agent, or Firm*—Ladas & Parry LLP

(57) ABSTRACT

A travelling waveguide antenna has top and bottom spaced plates, the top plate having radiating apertures extending therethrough. The apertures have inclined surfaces facing one another to provide an outward flare of the apertures.

33 Claims, 4 Drawing Sheets

FIG. 6
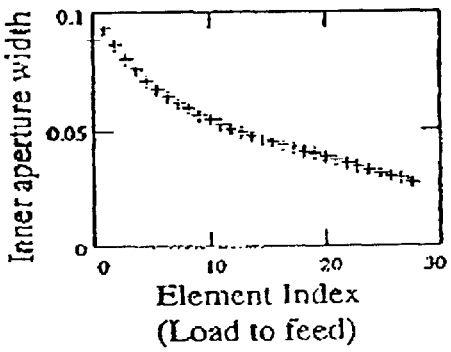
FIG. 7
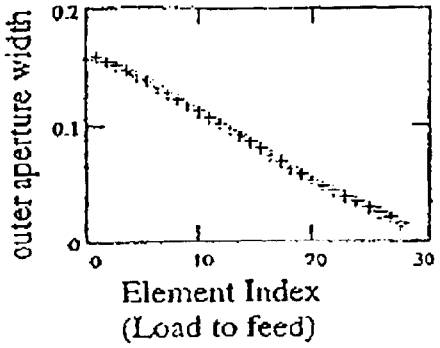
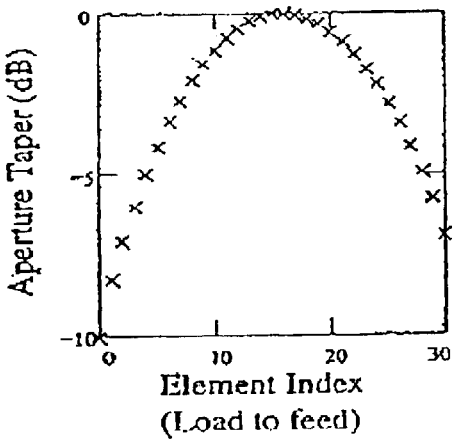
FIG. 8
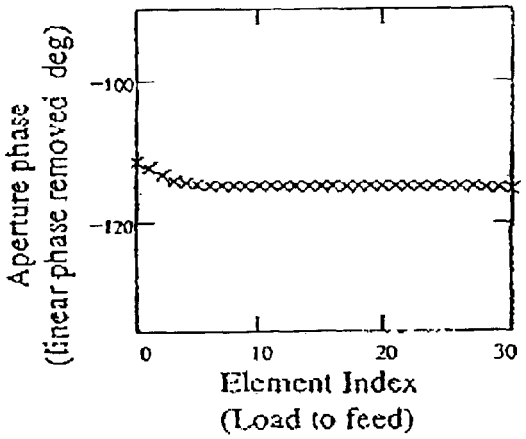
FIG. 9

WAVEGUIDE FOR A TRAVELING WAVE ANTENNA

This application claims that benefit of Provisional Application No. 60/322,125 filed Sep. 11, 2001.

BACKGROUND

1. Field

The present invention relates to a travelling wave antenna having low profile height or thickness while providing wideband operation. The antenna comprises a plate waveguide in which a transverse electromagnetic transmission (TEM mode) is propagated.

The invention further relates to methods of producing such waveguide with the low profile height and wide bandwidth at relatively minimal cost.

2. Description of Related Art

The use of waveguides for a travelling wave antenna is well known. Such antennas are well suited to consumer applications where the overall thickness of the waveguide must be kept to an absolute minimum. For example, for automotive applications, it is desirable to install the antenna within the roof of the vehicle. However, the antenna must not be visible and this imposes a rigid constraint on the overall thickness of the travelling wave antenna to about one inch.

FIGS. 1 and 2 diagrammatically illustrate the construction of a waveguide 1 of a travelling wave antenna which comprises upper and lower conductive plates 2 and 3 respectively, and a dielectric material 4 sandwiched between the plates. A line source (not shown) is coupled to an inlet end of the waveguide 1 to produce the propagated wave therein. The upper plate 2 is provided with a number of apertures 5 extending transversely thereacross almost the full width of the upper plate 2. The apertures 5 serve as a means for radiating energy and their design is especially crucial to achieve the desired performance of the antenna while maintaining the low profile or thickness t of the waveguide 1. In FIGS. 1 and 2, the apertures 5 have been shown as rectangular slots of constant width w. The thickness x of the upper plate 2 is about $\lambda/4$, where $\lambda$ is the wavelength of the incident energy.

In a first known embodiment shown in FIG. 3, in order to adjust the radiation energy of the waveguide, rectangular apertures 5A, 5B of different widths and heights are provided along the length of the waveguide. The different heights of the apertures are obtained by forming a step in the top plate 2*a* at each aperture. By adjusting the width and the height of the apertures 5A and 5B, various pattern amplitudes and phase shapings can be obtained. However, relatively narrow band slot impedance characteristics are produced. In addition, there is a limit to the impedance values that can be obtained and this may not be sufficient to provide the desired radiation performance. Consequently, this antenna construction often results in low bandwidth.

FIG. 4 shows an improved embodiment in which apertures of constant height are provided and the apertures have varied widths. Specifically, the top plate of the waveguide is formed by lower and upper plate members 2' and 2" respectively, each formed with respective rectangular apertures 5' and 5".

By adjusting the width of the rectangular apertures 5', 5" the radiation energy of the waveguide can be adjusted. The plate members 2' and 2" each have a thickness of approximately $\lambda/4$. The rectangular apertures 5', 5" formed in the plate members 2, 2" are rectangular slots having parallel faces. The width of the apertures 5', 5" can be varied along the length of the waveguide. The apertures 5' and 5" are aligned with one another and provide an overall stepped aperture having an inner aperture width formed by apertures 5' and a larger outer aperture width formed by apertures 5". Although this embodiment provides apertures with constant height and a wider range of aperture impedance, the overall height of the top plate is doubled which makes the waveguide unusable where thickness is critical.

Various additional aperture designs in waveguides are known and, by way of examples, U.S. Pat. Nos. 5,266,961 and 5,349,363 illustrate antennas in which the radiating apertures are formed by transverse stub elements formed on the top plate.

SUMMARY

An object of the invention is to provide an improved travelling wave antenna which avoids the above problems and provides wideband performance with the ability to obtain a large range of aperture impedances.

A further object of the invention is to provide a waveguide for the travelling wave antenna which preserves the low profile height, as the thickness of the top plate can be maintained at approximately $\lambda/4$.

In accordance with the invention, the radiation apertures are formed with inclined facing surfaces to provide an outward flare of the apertures so that a large range of aperture impedances can be realized by adjustment of the width of the apertures and their flare angles. The band width is improved because the aperture flare acts as a tapered waveguide impedance matching section which has good wideband performance for a given length. If the thickness of the top plate is preserved at approximately $\lambda/4$, then a small aperture with little flare angle gives extremely low coupling properties near the incident energy or feed end. This is contrary to the requirement for high coupling at the load end for electrically large antennas. If the aperture is made larger and a small flare angle is provided near the feed end, a higher degree of coupling will be obtained at the feed end, whereas if the aperture and flare angle are made smaller near the load end, a lower degree of coupling can be obtained thereat. By suitable adjustment, higher efficiency of the waveguide with low profile height can be obtained. Accordingly, a wide range of aperture impedances can be realized while maintaining low profile height.

In particular embodiments of the invention, the apertures can have a flare angle of between 5 and 90 degrees.

It is also possible to provide apertures with a negative flare angle in which the flare opening increases towards the bottom plate. This creates low coupling which is useful for very large antennas.

For usual applications, the apertures have a spacing or width at the lower surface of the top plate between 0.01 $\lambda$ and $\lambda/2$.

The flared faces of the apertures can be planar or curved. In the case of curved faces the flare will be non linear and, for example, it can be exponential or quadratic.

BRIEF DESCRIPTION OF THE DRAWINGS

FIGS. 6–9 show the parameters of an antenna design according to the present invention and the results obtained.

DETAILED DESCRIPTION

The present invention now will be described more fully hereinafter with reference to the accompanying drawings, in which preferred embodiments of the invention are shown. This invention may be embodied in many different forms and should not be construed as limited to the embodiments set forth herein.

Figure 1:
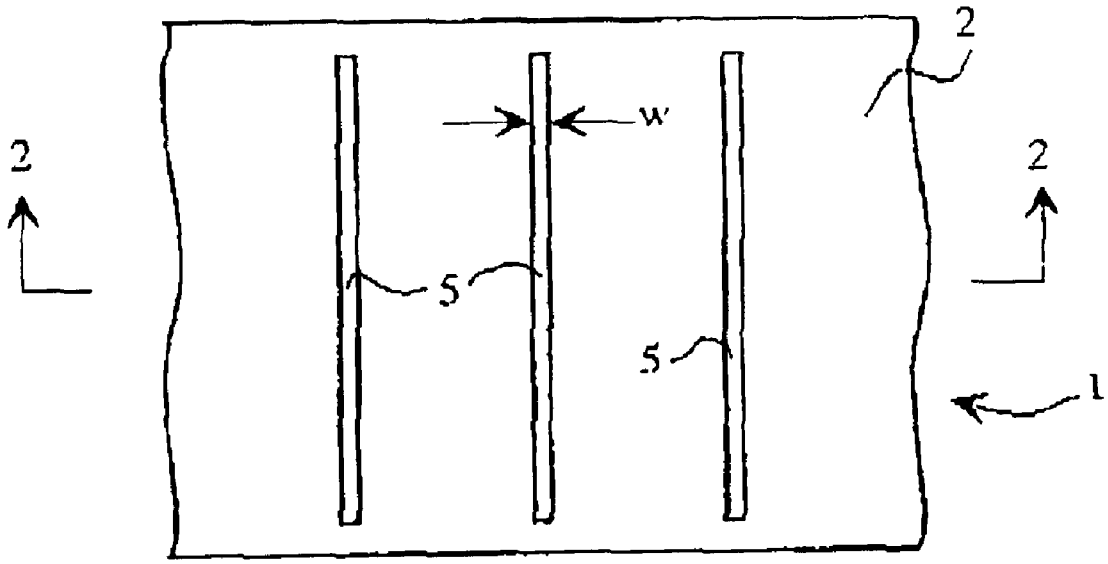
FIG. 1 (PRIOR ART)
FIG. 1 (prior art) is a diagrammatic illustration in top plan view of a portion of a waveguide known in the art.
Figure 2:
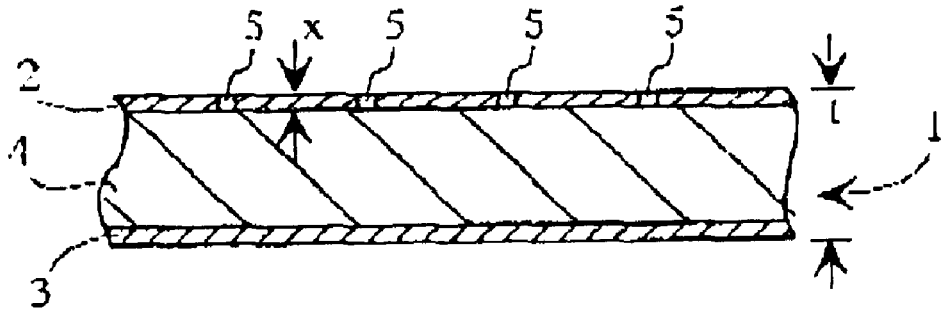
FIG. 2 (PRIOR ART)
FIG. 2 (prior art) is a cross-section taken along line 2—2 in FIG. 1.
Figure 4:
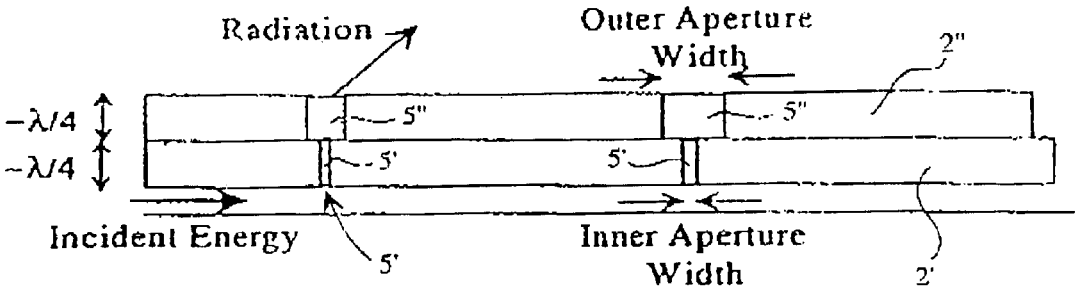
FIG. 4 (PRIOR ART)
FIG. 4 (prior art) is a cross-sectional view of the top plate of yet another waveguide known in the art.
Figure 3:
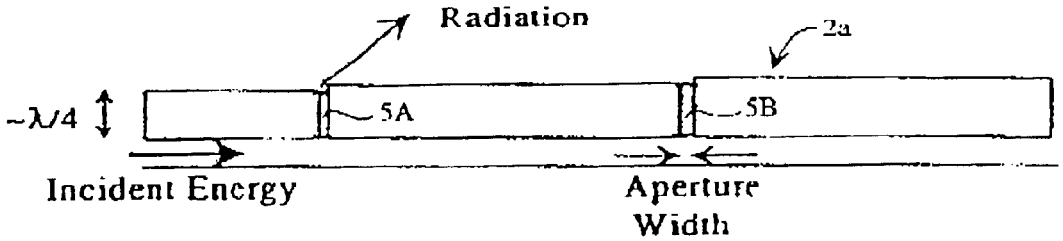
FIG. 3 (PRIOR ART)
FIG. 3 (prior art) is a sectional view showing the top plate of another waveguide known in the art.
Figure 5:
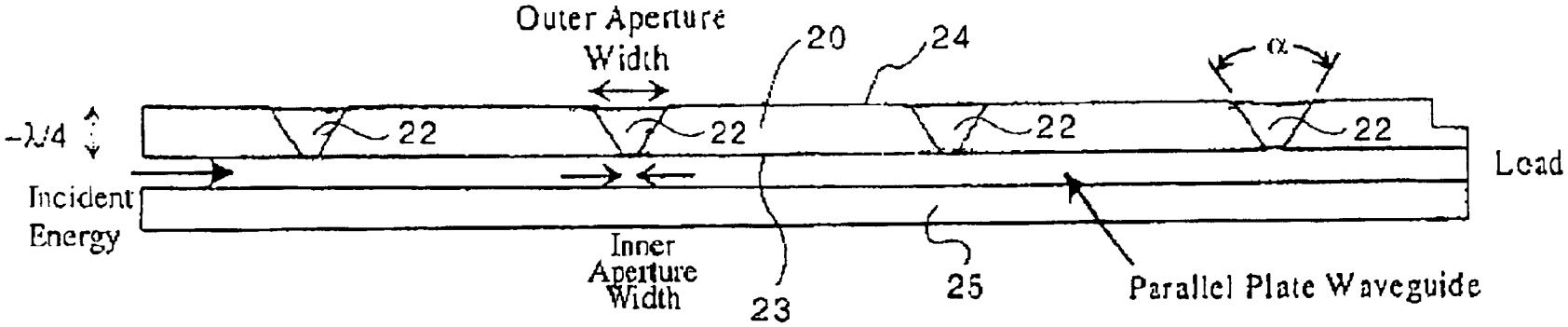
FIG. 5 is a cross-sectional view of a top plate of the waveguide of the invention.

Referring to FIG. 5, therein is shown the top plate 20 of a waveguide 21 according to the invention. FIG. 5 also shows a bottom plate 25 of the waveguide 21. The top plate 20 has a uniform thickness of approximately $\lambda/4$. Incident energy is input at the left end in FIG. 5 and the load is located at the right end. Radiating energy is discharged through apertures 22 provided in the top plate 20 in spaced relation therealong. The apertures 22 have a width at the inner surface 23 of the top plate 20 which is less than the width at the outer surface 24 of the top plate 20. Thereby, the apertures 22 are formed as flared apertures having inclined faces. The flared apertures 22 provide a means for varying the radiation energy of the waveguide 21 depending on its use while maintaining a uniform thickness of the top plate 20 of approximately $\lambda/4$ and preserving a minimum overall height of the waveguide 21. The parameters for adjustment of the radiation energy are the width of the aperture 22 at the inner surface of the top plate 20 and the flare angle $\alpha$ of the sides of the aperture 22.

In the preferred embodiments of the invention, the width of the aperture 22 at the inner surface 23 is between $0.01\lambda$ and $\lambda/2$ and the width of the aperture 22 at the outer surface 24 of the top plate 20 is a function of the flare angle $\alpha$. The flare angle $\alpha$ of the flared aperture 22 is generally between 5 and 90 degrees.

It is to be understood that the flare angle and width dimensions of the apertures 22 are conditioned on the wavelength and the properties of the waveguide 21 that are to be obtained.

By providing the flare of the apertures 22 in the top plate 20, it is possible to provide wide adjustment of the radiation energy and aperture impedance while retaining the thickness of the top plate 20 at about $\lambda/4$ in a simple and low cost method of production.

In general, since low coupling is desirable at the feed end, the flare angle and aperture width will be relatively small, while at the load end, the flare angle and aperture width can be increased to provide higher coupling.

In FIG. 5, the faces of aperture 22 are planar. In a modification as shown in FIG. 5A, the faces of apertures 22' are curved so that the flare angle will not be linear as in FIG. 5, but can provide an exponential or quadratic relation.

As seen from the above, the invention provides a plate waveguide 21 with radiating apertures 22 which are continuous in the transverse direction and wherein each aperture 22 has a specific width at its inner end and a specific flare angle. The apertures 22 may have different and respective dimensions based on the impedance to be obtained. Other factors which play a role in the coupling properties of the apertures are the overall height of the waveguide 21. For greater height, i.e. for greater spacing between the top and bottom plates, the lower the coupling, while for smaller spacing between the top and bottom plates the greater the coupling. Thus, a further adjustment parameter for coupling is the formation of an angle between the plates to vary the spacing. Although the drawings show parallel top and bottom plates, the plates can be angulated to vary the coupling at the feed end and at the load end. That is, the angle between the plates may be other than 180°. The determination of the parameters of aperture width, flare angle and angulation of the top and bottom plates is a function of desired overall height of the waveguide 21 and the coupling properties at the feed end and at the load end. The width of the aperture 22 at its lower end and the flare angle of the aperture 22 are selected to radiate particular amounts of power at a particular phase relative to the other apertures, thus, producing the desired antenna pattern.

Figure 5B:
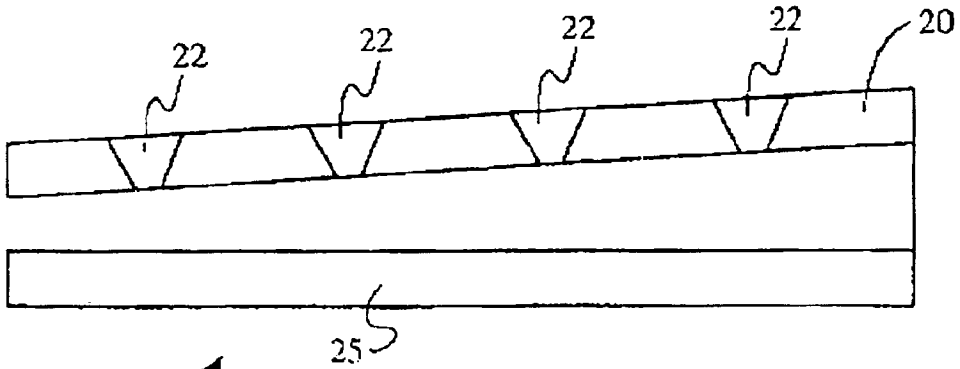
FIG. 5B is a cross-sectional view of an angulated waveguide according to an embodiment of the present invention.
Figure 5A:
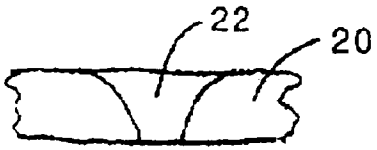
FIG. 5A is a cross section through a portion of the top plate illustrating a modified embodiment of a flared aperture in the top plate.

FIG. 5B shows a waveguide 30 according to the present invention with a top plate 20 with apertures 22 and a bottom plate 25. FIG. 5B also shows an angle other than 180° between the top plate 20 and the bottom plate 25, as discussed above.

The parameters of an antenna design according to the present invention and the results obtained are shown in FIGS. 6–9. FIG. 6 shows the variations of the inner widths of the apertures. FIG. 7 shows the variations of the outer widths of the apertures. FIGS. 8 and 9 show the resulting amplitude and phase distribution of the elements. The operating center frequency was 12.2 GHz and the dimensions are given in inches. The thickness of the top plate of the waveguide is 0.300 inches.

The above parameters are given solely by way of example to show the capability of addressing the radiation properties of the waveguide by virtue of the variation of the flare angle and width of the apertures.

From the foregoing description, it will be apparent that the present invention has a number of advantages, some of which have been described herein, and others of which are inherent in the embodiments of the invention described herein. Although the invention is disclosed with reference to particular embodiments thereof, it will become apparent to those skilled in the art that numerous modifications and variations can be made without departing from the teachings of the subject matter described herein. As such, the invention is not to be limited to the described embodiments except as required by the appended claims.

What is claimed is:

1. A waveguide for a travelling wave antenna comprising top and bottom spaced plates and a dielectric uniformly dispersed everywhere between said top and bottom spaced plates, said top plate having radiating apertures extending therethrough, said apertures having inclined surfaces facing one another which provide a flare of said apertures.

2. The waveguide as claimed in claim 1, wherein said thickness of the top plate is equal to about one-quarter of the wavelength of a travelling wave input to the waveguide.

3. The waveguide as claimed in claim 1, wherein the flare of the apertures is between 5 degrees and 90 degrees.

4. The waveguide as claimed in claim 1, wherein the apertures flare outwardly.

5. The waveguide as claimed in claim 1, wherein each aperture has a width at an inner surface of the top plate between 0.01λ and λ/2 where λ is the wavelength of a travelling wave input to the waveguide.

6. The waveguide as claimed in claim 1, wherein said inclined surfaces of said apertures are planar.

7. The waveguide as claimed in claim 1, wherein said inclined surfaces of said apertures are curved.

8. The waveguide as claimed in claim 1, wherein the top and bottom spaced plates are disposed parallel to each other.

9. The waveguide as claimed in claim 1, wherein the top and bottom spaced plates are disposed at an angle to each other, wherein said angle is not 180°.

10. The waveguide as claimed in claim 1, wherein the top plate has a uniform thickness along its length.

11. The waveguide as claimed in claim 1, wherein said dielectric comprises air.

12. The waveguide as claimed in claim 1, wherein said waveguide has an incident end and each one of said apertures is spaced at increasing distance from said incident end, and each one of said apertures has an inner width and an outer width, wherein said inner width and outer width of each one of said apertures decrease as the distance of each one of said apertures from the incident end increases.

13. In a waveguide of a travelling wave antenna, having top and bottom spaced plates and radiating apertures extending through the top plate, an improvement wherein said apertures are flared and widen from one surface of said top plate to an opposite surface of said top plate.

14. The improvement as claimed in claim 13, wherein said top plate has a thickness equal to about one-quarter of the wavelength of the travelling wave input to said top plate.

15. The improvement as claimed in claim 13, wherein the flare of the apertures is between 5 degrees and 90 degrees.

16. The improvement as claimed in claim 13, wherein said one surface is an inner surface of the top plate and said opposite surface is an outer surface of the top plate and the apertures flare outwardly from the inner surface to the outer surface.

17. The improvement as claimed in claim 13, each aperture has a width at an inner surface of the top plate between 0.01λ and λ/2 where λ is the wavelength of a travelling wave input to the waveguide.

18. The improvement as claimed in claim 13, wherein each aperture has opposite inclined faces which are planar so that the apertures flare linearly.

19. The improvement as claimed in claim 13, wherein each aperture has opposite inclined faces which are curved so that the apertures flare non-linearly.

20. The improvement as claimed in claim 13, wherein the top and bottom spaced plates are disposed parallel to each other.

21. The improvement as claimed in claim 13, wherein the top and spaced plates are disposed at an angle to each other, wherein said angle is not 180°.

22. The improvement as claimed in claim 13, wherein the space between said top and bottom spaced plates is hollow everywhere between said top and bottom spaced plates.

23. The improvement as claimed in claim 13, wherein the space between said top and bottom spaced plates is uniformly filled with dielectric material.

24. The improvement as claimed in claim 13, wherein said waveguide has an incident end and each one of said radiating apertures is spaced at increasing distance from said incident end, and each one of said apertures has an inner width and an outer width, wherein said inner width and outer width of each one of said apertures decrease as the distance of each one of said apertures from the incident end increases.

25. A method of providing a travelling wave antenna with a low profile height in which the travelling wave antenna has a waveguide with spaced top and bottom conductor plates, the top conductor plate being provided with energy radiating apertures spaced therealong, said method comprising forming said energizing radiating apertures with inclined facing surfaces to form a flare so that said apertures widen from one surface of the top plate to an opposite surface of the top plate and uniformly providing dielectric everywhere between said spaced top and bottom conductor plates.

26. The method as claimed in claim 25, comprising regulating energy radiation through said apertures with determined impedance by providing the apertures with specific widths at said one surface of the top plate and with specific flare angles.

27. The method as claimed in claim 25, wherein said one surface of the top plate is the inner surface and the opposite surface of the top plate is the outer surface, said apertures flaring outwardly in the top plate.

28. The method as claimed in claim 25, wherein said inclined facing surfaces of said apertures are planar.

29. The method as claimed in claim 25, wherein said inclined facing surfaces of apertures are curved.

30. The method as claimed in claim 25, wherein the spaced top and bottom conductor plates are disposed parallel to each other.

31. The method as claimed in claim 25, wherein the spaced top and bottom conductor plates are disposed at an angle to each other, wherein said angle is not 180°.

32. The method as claimed in claim 25, wherein said dielectric comprises air.

33. The method as claimed in claim 25, wherein said waveguide has an incident end and each one of said radiating apertures is spaced at increasing distance from said incident end, and each one of said apertures has an inner width and an outer width, wherein said inner width and outer width of each one of said apertures decrease as the distance of each one of said apertures from the incident end increases.

* * * * *